United States Patent [19]

Pettersson

[11] Patent Number: 4,665,825

[45] Date of Patent: May 19, 1987

[54] ARRANGEMENT FOR INTERCONNECTING A PROJECTILE AND A PROJECTILE EXTENSION COMPONENT

[75] Inventor: Rolf T. Pettersson, Ärla, Sweden

[73] Assignee: Affarsverket FFV, Eskilstuna, Sweden

[21] Appl. No.: 842,170

[22] Filed: Mar. 21, 1986

Related U.S. Application Data

[63] Continuation-in-part of Ser. No. 577,707, Feb. 7, 1984, abandoned.

[30] Foreign Application Priority Data

Feb. 9, 1983 [SE] Sweden ..... 8300665

[51] Int. Cl.[4] ..... F42B 13/28

[52] U.S. Cl. ..... 102/372; 102/378; 102/445; 102/501; 102/517; 102/529

[58] Field of Search ..... 102/372, 373, 377, 378, 102/501, 517–519, 524–529, 445, 473

[56] References Cited

U.S. PATENT DOCUMENTS

| | | | |
|---|---|---|---|
| 43,615 | 7/1864 | Williams | 102/525 |
| 2,856,856 | 10/1958 | Michael | 102/526 |
| 2,945,442 | 7/1960 | Adelman et al. | 102/378 |

FOREIGN PATENT DOCUMENTS

| | | | |
|---|---|---|---|
| 116430 | 5/1946 | Sweden | 102/378 |

*Primary Examiner*—Harold J. Tudor

*Attorney, Agent, or Firm*—Fleit, Jacobson, Cohn & Price

[57] ABSTRACT

Arrangement for interconnecting a projectile and a projectile extension component. The projectile and the extension component each incorporates its own connecting element which are capable of being introduced into each other by causing one of the connecting elements to be so deformed as to be retained in its deformed state in the second connecting element. The connecting elements are capable of being introduced into each other with the help of the firing forces whose effect is immediate when the projectile and the extension component are fired from the barrel of a weapon.

4 Claims, 6 Drawing Figures

ARRANGEMENT FOR INTERCONNECTING A PROJECTILE AND A PROJECTILE EXTENSION COMPONENT

This application is a continuation-in-part of U.S. patent application Ser. No. 577,707, now abandoned filed Feb. 7, 1984.

The present invention relates to a device for interconnecting a projectile and a projectile extension.

In conjunction with the firing of mortar projectiles it is desirable, if required, to be able to provide the projectile with a rearward projectile extension component, which will endow the projectile with a certain desired additional function. The extension component may, for example, contain a propulsion means for increasing the range of the projectile. As an alternative, it may contain an explosive charge.

In the case of projectiles with the facility for connecting an extension component, one requirement is that the firer himself shall be able to connect the extension component to the projectile. The problem associated with this until now has been to provide a means of connection between the projectile and the extension component which is not only sufficiently strong to withstand the stresses encountered on firing and during flight, but which could also offer the possibility of the extension component being separated from the projectile during a specific phase of its flight. This problem is resolved in that the arrangement in accordance with the invention has been given the characteristics indicated in claim 1.

Further embodiments of the invention are set forth in the subclaims.

The invention will be described in greater detail below with reference to the accompanying drawing which illustrates a number of different embodiments of the invention.

Figure 1:
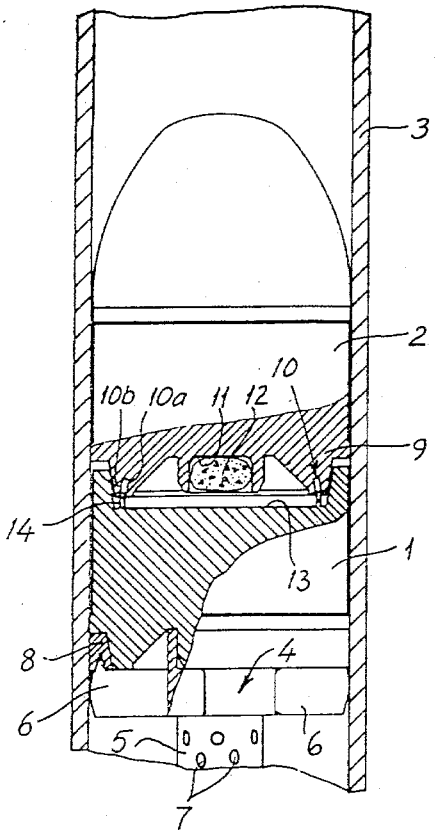
FIG. 1 is a broken longitudinal cross section through a mortar projectile and a propulsion motor after having been introduced into the loaded position inside the barrel of a mortar, wheras

FIG. 1 illustrates how a projectile extension component in the form of a propulsion motor 1 and a mortar projectile 2 have been introduced in that order via the smooth-bore barrel 3 of a mortar into a loaded position, said propulsion motor 1 being in loose contact with a propellant charge component 4. The latter comprises in a previously disclosed fashion a cartridge tube 5 which is retained by means of guide means 6 in a centered position inside the barrel. The walls of the cartridge tube 5 are, also in a previously disclosed fashion, provided with a number of transcurrent holes 7 providing an exhaust channel for the gases generated by a propellant charge contained in the cartridge tube.

In the loaded position illustrated in FIG. 1 the propulsion motor 1 and the projectile 2 are in loose contact with each other. This makes it possible for the firer to change his mind, if necessary, and to remove the propulsion motor from the barrel, thereby enabling the projectile to be fired instead without a propulsion motor.

The designation 8 is used to indicate an annular sealing girdle intended to protect vulnerable parts of the propulsion motor 1 or the projectile 2 against the gases from the propellant charge component 4. The girdle 8 also forms a seat against which the rear edge of the propulsion motor rests in the loaded position.

The projectile 2 has a rear face 9 into which has been cut an annular groove 10, constituting a first connecting element for the connecting together of the projectile 2 and the propulsion motor 1. The walls 10*a* and 10*b* of the groove 10 are parallel to each other and form an angle of about 10–20 degrees with the centre axis of the projectile.

On the rear face 9 is also a central cavity 11 inside which is arranged a separation powder charge 12. This charge is intended to be ignited at a pre-determined phase of the trajectory of the projectile and to generate gases which will cause the propulsion motor 1 to be separated from the projectile 2.

The propulsion motor 1 exhibits a front face 13 from which projects an annular flange 14 constituting a second connecting element for the connecting together of the projectile 2 and the propulsion motor 1. The walls of the flange 14 are parallel to the centre axis of the projectile.

The flange 14 is made of metal, preferably aluminium or some other plastic deformable metal, and is so positioned that, when it is introduced into the loaded position in the barrel 3, it will lie directly in line with the opening of the groove 10, as shown in FIG. 1.

Figure 2:
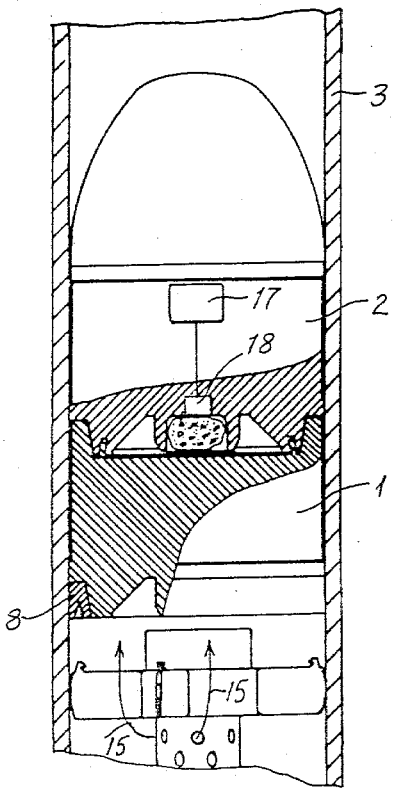
FIG. 2 is a cross section of the same projectile and propulsion motor immediately after the mortar has been fired.

On firing the mortar, which is done in a previously disclosed fashion by causing the propellant charge in the propellant charge component 4 to be ignited, gases from this will rush out through the holes 7, as indicated by the arrows 15 in FIG. 2, thereby causing the propulsion motor 1 and the projectile 2 to accelerate out of the barrel 3. The acceleration forces thus generated cause the propulsion motor 1 to press its flange 14 into the groove 10 on the projectile 2. Because the walls 10*a* and 10*b* of the groove are inclined to the centre axis of the projectile, the flange 14 will be bent and forced to assume the shape of the groove 10. This sideways deformation of the flange 14 causes it to remain in the groove 10 so that the propulsion motor 1 is held securely by the projectile 2.

Figure 3:
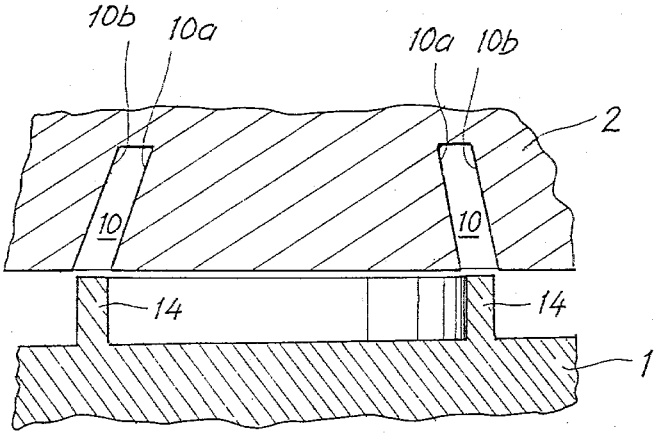
FIGS. 3 and 4 are broken longitudinal sections through and on an enlarged scale of the connecting elements shown in FIGS. 1 and 2 before and after the firing of the mortar, respectively.
Figure 4:
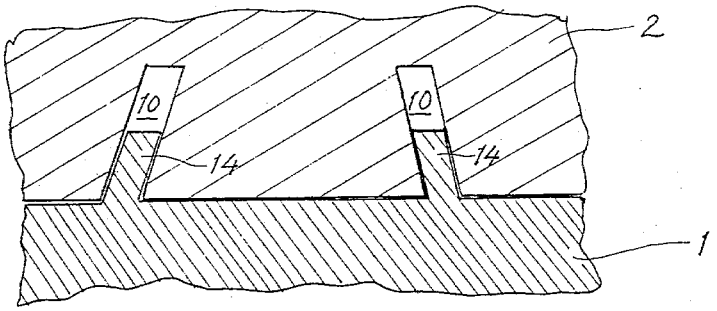

The deformation function of the plastic deformable means 14 is illustrated in more detail in FIGS. 3 and 4 which on an enlarged scale schematically show the connecting elements 10 and 14 of FIGS. 1 and 2 before and after firing of the mortar, respectively. In view of simplicity of the drawing, the central cavity 11 and its separation charge 12 has been omitted in FIGS. 3 and 4.

In its inoperative, non-deformed state, the side surfaces of the flange 14 are parallel with the centre axis of the projectile, whereas the two walls 10*a* and 10*b* of the groove 10 are inclined relative to the centre axis of the projectile.

In FIG. 4 it will be seen that the flange 14 has been bent and deformed sideways into the groove 10 such that it partially fills the groove, the flange 14 and groove 10 thereby securely interconnects the projectile 1 and the propulsion motor 2.

It is evident that the criterium for interconnecting the flange 14 and groove 10 is that the flange 14 must be bent sideways over the wall 10*a* of the groove 10, i.e. over at least one inclined wall of the groove 10.

When the mortar is fired, the gases will cause the girdle 8 to expand slightly, causing it to become detached from the guide means 6 and at the same time to be held securely against the rear edge of the propulsion motor 1, so that the girdle will accompany the propulsion motor 1 as it leaves the barrel, as shown in FIG. 2. As soon as the propulsion motor 1 has left the barrel 3 and the gases no longer exert an influence on the girdle 8, the girdle will fall away from the propulsion motor 1.

It is possible, as mentioned above, to use the separation charge 12 to cause the propulsion motor 1 to separate at a desired stage of the trajectory of the projectile once it has fulfilled its purpose. For this purpose the charge 12 is pre-arranged in a previously disclosed fashion to be ignited a certain time after it is fired, in so doing generating gases at such a pressure that the flange 14 will be forced out of the groove 10, thereby separating the propulsion motor 1 from the projectile 2.

The separation of the propulsion motor 1 may be done in a manner known per se by means of a time-fuze 17 schematically shown in FIG. 2, capable of actuating an ignition means 18 in order to ignite the separation charge 12. The ignition means 18 may, for instance be a conventional electric ignition means. Since such time-fuze and ignition means are well-known to those skilled in the art, they are not described further here.

The groove 10 may within the idea of invention exhibit many shapes other than that illustrated in FIGS. 1 and 2. The cross-section of the groove may, for example, be L-shaped, or may exhibit the form of a dovetail, as illustrated in FIGS. 5 and 6.

In the case of a dovetail groove 10, the flange 14 will not be deformed by bending, as was the case in FIGS. 1–4, but the material of the flange will be forced to "float" sideways to completely or almost completely fill the groove 10. In this dovetail case, the deformed flange 14 is by means of material floating brought into abutment with the two opposite, inclined surfaces of the dovetail groove, but it is of course evident that the groove 10 might alternatively have the shape of a half dovetail, i.e. a shape with only one inclined surface, whereas the opposite side of the groove is parallel to the centre axis of the projectile. Thus, at least one side wall of the dovetail groove must be inclined.

Figure 5:
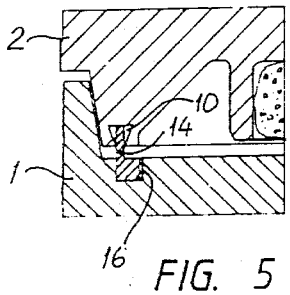
FIGS. 5 and 6 are broken longitudinal sections through and on an enlarged scale of a modified embodiment of the connecting elements of the projectile and the propulsion motor before and after the firing of the mortar, respectively.
Figure 6:
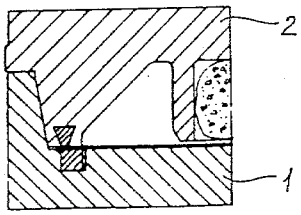

The embodiment in accordance with FIGS. 5 and 6 may provide such a strong connection between the flange 14 and the groove 10 that the separation charge 12 will not always be capable of forcing the flange 14 out of the groove 10. In order to solve this problem the flange 14 in these embodiments is attached to the propulsion motor 1 by means of the threaded union, as indicated by the designation 16 in FIG. 5. A union of this kind is easily dimensioned so as to be sufficiently weak to be forced apart by the gases from the separation charge 12.

It is also conceivable within the idea of invention to cause the groove 10 and the flange 14 to be transposed, that is to say to arrange the groove 10 in the end face 13 of the propulsion motor and the flange 14 in the rear face 9 of the projectile.

I claim:

1. A device for temporarily interconnecting a mortar projectile and a projectile extension, said device comprising:

two connecting elements, one connecting element being defined by each of said mortar projectile and said projectile extension, one connecting element forming a cavity facing the other connecting element, said other connecting element including at least one plastic deformable means for introduction into said cavity, said cavity being limited by at least one side wall forming an angle with a center axis of said mortar projectile, said at least one plastic deformable means being deformable sideways from a non-deformed state in which one side surface thereof has an angular orientation which is different from that of said side wall, into a deformed state in which said side surface has got the same angular orientation as said side wall, said at least one plastic deformable means capable of being introduced into said cavity with said side surface into engagement with said at least one side wall only by the sideways deformation of said at least one plastic deformable means from said nondeformed state into said deformed state, said at least one plastic deformable means at least partially filling said cavity and remaining inside said cavity to interconnect said mortar projectile and said projectile extension in said deformed state, said mortar projectile including a separation powder charge located facing said connecting element of said projectile extension, said separation powder charge being ignited at a pre-determined phase of the trajectory of the mortar projectile to generate gases causing the projectile extension to separate from said mortar projectile.

2. A device as claimed in claim 1, wherein said other connecting element and said cavity are aligned with each other so that when said mortar projectile and said projectile extension are loaded into a barrel of a weapon, said other connecting means is caused to penetrate inside said cavity as a result of firing forces generated upon said weapon being fired.

3. A device for interconnecting a projectile and a projectile extension, said device comprising:

two connecting means located opposed to each other for temporarily interconnecting said projectile and said projectile extension, one connecting means including a cavity and the other connecting means including deformable means for interconnecting said two connecting means, said deformable means being deformable sideways from a non-deformed state in which one side surface thereof has an angular orientation which is different from that of said side wall, into a deformed state in which said side surface has got the same angular orientation as said side wall, said deformable means being deformed from said non-deformed state to said deformed state when entering and at least partially filling said cavity to interconnect said two connecting means, and separating means for separating said deformable means from said cavity, said separating means being operable at a specific phase of the trajectory of the projectile and projectile extension when said projectile and projectile extension are interconnected by said two connecting means to disconnect said two connecting means and thereby disconnect said projectile and said projectile extension.

4. A device as claimed in claim 3, wherein said other connecting means and said cavity are aligned with each other so that when said projectile and said projectile extension are loaded into a barrel of a weapon, said other connecting means is caused to penetrate inside said cavity as a result of firing forces generated upon said weapon being fired.

* * * * *